US010087682B2

(12) United States Patent
Pfeifer

(10) Patent No.: US 10,087,682 B2
(45) Date of Patent: Oct. 2, 2018

(54) STORAGE TRAY FOR A LADDER AND LADDER WITH THIS STORAGE TRAY

(71) Applicant: Hailo-Werk Rudolf Loh GmbH & Co. KG, Haiger (DE)

(72) Inventor: Rudolf Pfeifer, Mudersbach (DE)

(73) Assignee: Hailo-Werk Rudolf Loh GmbH & Co. KG, Haiger (DE)

( * ) Notice: Subject to any disclaimer, the term of this patent is extended or adjusted under 35 U.S.C. 154(b) by 0 days.

(21) Appl. No.: 15/431,396

(22) Filed: Feb. 13, 2017

(65) Prior Publication Data

US 2017/0234069 A1 Aug. 17, 2017

(30) Foreign Application Priority Data

Feb. 12, 2016 (DE) ..... 20 2016 100 719 U

(51) Int. Cl.
*E06C 7/14* (2006.01)
*B25H 3/06* (2006.01)

(52) U.S. Cl.
CPC *E06C 7/14* (2013.01); *B25H 3/06* (2013.01)

(58) Field of Classification Search
CPC ..... E06C 7/14; E06C 7/16; E06C 7/00; E06C 7/143
USPC ..... 248/210, 211, 238; 182/116, 121, 129
See application file for complete search history.

(56) References Cited

U.S. PATENT DOCUMENTS 5,603,405 A * 2/1997 Smith ..... E06C 7/14 182/129
5,901,998 A * 5/1999 Gallo, Jr. ..... B25H 3/06 182/129
6,098,748 A * 8/2000 Harper, Jr. ..... B25H 3/02 182/129
6,401,862 B1 * 6/2002 Caron ..... E06C 7/14 182/120
7,753,170 B1 * 7/2010 Gibson ..... E06C 7/14 182/107
2001/0025908 A1 * 10/2001 Ahl ..... E06C 7/14 248/211
2002/0070136 A1 * 6/2002 Hedges ..... B25H 3/00 206/373
2002/0070137 A1 * 6/2002 Hedges ..... B25H 3/00 206/373
2002/0100848 A1 * 8/2002 Ahl ..... E06C 7/146 248/211
2013/0319884 A1 * 12/2013 Gomez ..... F16M 13/06 206/216

* cited by examiner

*Primary Examiner* — Steven M Marsh
(74) *Attorney, Agent, or Firm* — Edell, Shapiro & Finnan, LLC.

(57) ABSTRACT

The described apparatus relates to a storage tray for a ladder, in particular a runged stepladder, wherein the storage tray has at least one compartment into which objects can be placed, and has a first receiver for a first element of a buckle closure, which can be attached on the storage tray.

8 Claims, 15 Drawing Sheets

STORAGE TRAY FOR A LADDER AND LADDER WITH THIS STORAGE TRAY

CROSS REFERENCE TO RELATED APPLICATIONS

This application claims foreign priority under 35 U.S.C. § 119(a)-(d) to Application No. DE 202016100719.4 filed on Feb. 12, 2016, the entire contents of which are hereby incorporated by reference.

FIELD OF THE INVENTION

The described apparatus relates to a storage tray. The described apparatus furthermore relates to a ladder with this storage tray.

BACKGROUND

A runged stepladder with a storage tray is known from the document DE 20 2007 002 103 U1. The storage tray connects the upper ends of the rails of a fly section of the runged stepladder. The storage tray features various holes that can be used as receivers for inserting tools such as screwdrivers or to insert portable tools such as battery-powered screwdrivers or power drills. The design also features a compartment that can be used to deposit a wide range of objects such as screws or other hardware items. The design finally also features a so-called bucket hook used for hanging into or onto a bucket or other objects.

The past has shown that the storage tray known from the document DE 20 2007 002 103 U1 meets its purpose. However, the desire was occasionally expressed to better secure the object hung on the bucket hook. Users also expressed the desire to hook several objects into or onto the storage tray at the same time. Users also expressed a need for greater flexibility in the form of having the ability to hook objects into or onto several sides of the storage tray.

SUMMARY

The described storage tray and ladder system builds on the aforementioned.

The object of the described apparatus is to propose a storage tray that provides greater flexibility and facilitates improved securing of hooked-on objects.

This object is solved according to the described apparatus in that the storage tray has a first receiver for an element of a buckle closure that can be attached to the storage tray.

This object is furthermore solved in that the storage tray features several second receivers for hooks, which can be attached on the storage tray.

A buckle closure is a closure arrangement as for instance described in the document DE 203 16 449 U1. Buckle closures are conventionally used to close belt connections. Buckle closures are in particular used on pocketbooks to close the flap of a pocketbook.

The first receiver of a storage tray according to the described apparatus can be a through hole. A catch for the first element of the buckle closure can be arranged in this through hole. The first part of the buckle closure can be easily positioned with the help of the catch. The first element can be a male buckle closure element.

According to the described apparatus, the design provides that the first element of a buckle closure can be guided into the first receiver from a first side of the storage tray.

The first receiver is additionally arranged such that a second element of the buckle closure can be guided into the first receiver from a second side of the storage tray. This second element of the buckle closure can be a female buckle closure element.

According to the described apparatus, the design provides that the storage tray has a first hole transverse to the first receiver into which a locking device can be inserted to secure the first element of the buckle closure.

The second receivers of a storage tray according to the described apparatus can at least in sections feature a non-circular first cross-sectional area. This non-circular cross-sectional area necessitates that a hook can only be inserted into and withdrawn from the second receiver in a specific orientation, thus rendering an accidental release of the hook from the second receivers more difficult.

At least one of the second receivers can have a receiving direction oriented parallel to an upper side of the storage tray. In addition, at least one of the second receivers can have a receiving direction oriented vertically to the upper side of the storage tray. This permits hooks to be attached to the storage tray in various orientations.

On an arrangement consisting of a storage tray according to the described apparatus, a belt and a buckle closure, a first element of the buckle closure can be attached to first end of the belt, and the first element of the buckle closure can be guided into the first receiver of the storage tray from the first side of the storage tray. The first element of the buckle closure can be attached in the first receiver in contact with the catch.

The arrangement can feature a locking device, for instance a pin or a bar or a cotter pin guided into the storage tray into a pocket in the first element of the buckle closure through the at least first hole in the storage tray, in order to secure the first element of the buckle closure from being pulled out of the first receiver.

A second element of the buckle closure is preferably attached on a second end of the belt. By connecting the first and the second element of the buckle closure, the first and the second end of the belt can be connected with each other to form a loop. This loop can be used to hang objects or to secure objects hung onto the storage tray or onto a hook on the storage tray.

In an arrangement according to the described apparatus consisting of a storage tray and a hook, the hook can feature an insert section that is inserted into one of the second receivers.

The insert section of the hook can on at least one location feature a cross-sectional area that corresponds to the first cross-sectional area of the second receivers. The insert section of the hook and the second receivers together act like a key and a lock, so that the hook can be inserted into the second receivers and then again be extracted from the second receiver in only one or as few orientations as possible.

The hook of an arrangement according to the described apparatus can feature an interim section angled at approximately 90° to the insert section, and can feature a hook section angled at approximately 90° to the interim section, wherein the interim section connects the insert section and the hook section. This two-fold angle arrangement has the advantage that the hook section can be swiveled in a large angle range to assume various positions relative to the storage tray.

BRIEF DESCRIPTION OF THE DRAWINGS

Other characteristics and benefits of the present described apparatus become apparent based on the following description of a preferred embodiment by referencing the included figures.

DETAILED DESCRIPTION

Figure 1:
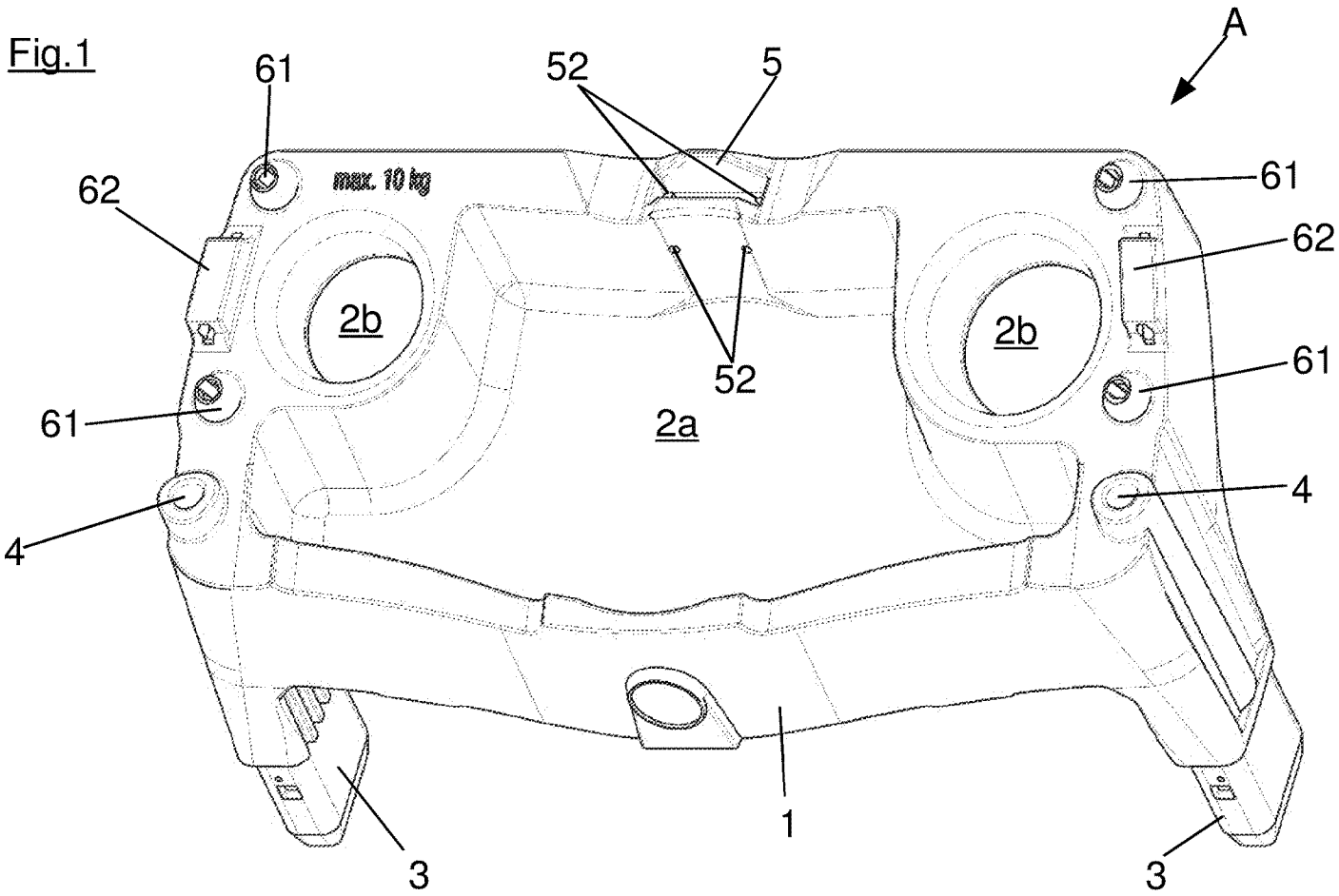
FIG. 1 is a view of the storage tray from the bird's eye perspective.

The storage tray A shown in the figures exhibits many elements already known from the storage tray of the runged stepladder from the document DE 20 2007 002 103 U1.

The storage tray features without limitation two extensions 3 by which the storage tray can be inserted into the upper ends of rails of a fly section of a runged stepladder, and can then be secured on these upper ends of the rails. The two extensions 3 are connected by a center section 1, in which the design provides a compartment 2*a* for storing objects. The design also provides two circular through holes 2*b*, which can be used as receivers for portable tools, such as a battery-powered screwdriver.

The storage tray furthermore features two as such already known through holes 4, which can accommodate rods 7 of a bar 7, 8, which is slidingly guided in the rails of the runged stepladder, which is as such already known from the document DE 20 2007 002 103 U1. Appropriate reference is made to the document DE 20 2007 002 103 U1.

The storage tray features a first receiver 5. This is formed by a through hole that extends from an upper side to a bottom side of storage tray A, having an essentially rectangular cross-section. FIGS. 7 to 9*a* show that a buckle closure S is arranged in the first receiver 5. A first element S1 of the buckle closure S is in this case attached in receiver 5.

If the first element S1 of the buckle closure S represents the male element the buckle closure S, a lock can be achieved by pressing inward two outwardly arched prongs S10 of the first buckle closure element S1 while inserting the male element of the buckle closure S1 in order to move the latter past a catch 50, which is arranged in the first receiver 5. As soon as the outwardly arched regions of the prongs S10 have moved past the catches 50, a support S11 of the first buckle closure element S1 can come to rest on the catch 50. The first element of the buckle closure S1 of the depicted exemplary embodiment is inserted into the first pocket 5 from below.

Two smaller through holes 52, which extend through the walls 53 of the storage tray delimiting the first receiver 5, are arranged transverse to the first receiver 5 at a distance to each other. The through holes 52 also extend through a wall 53 delimiting the compartment 2 and through a wall 53 on the rear of the storage tray.

The first element S1 of the buckle closure inserted into the first receiver 5 features through holes or a through slot S12. The legs of a U-shaped clamp K can be inserted through these holes or slot S12 in the first element S1 of the buckle closure S and the through holes 52 in the area of the first receiver 5, in order to secure the first element S1 of the buckle closure S in the receiver 5.

A first end of a belt G is attached on the first element S1 of the buckle closure S on the side facing away from the prongs S10. A second buckle closure element S2—the female buckle closure element in the present example—is attached on a second end of belt G. This second buckle closure element S2 has a receiver into which the prongs S10 of the first buckle closure element S1 can be inserted and engaged in the manner known as such. For this purpose, the second element S2 of the buckle closure S can be inserted from above into the first receiver 5 of storage tray A, and can then be pushed onto the prongs S10 of the first element S1 of the buckle closure S. Belt G then forms a loop that can be used to hang and secure objects.

The storage tray A also features second receivers 61, 62 for hooks H, which can be attached to storage tray A. Four second receivers 61 that feature a receiving direction for hooks H vertical to the upper side of the storage tray A are located under the second receivers 61, 62. Two additional second receivers 62 have a receiving direction extending parallel to the upper side of the storage tray A. This allows hooks H to be attached in various orientations to the storage tray A.

Whereas the hooks H inserted into the four first second receivers 61 are oriented in a manner that the user can hang objects into these, the two second second receivers 62 are oriented in a manner that the user can hang a tool handle with hook H, for instance the broomstick of a broom, as is known from the prior art.

Figure 2:
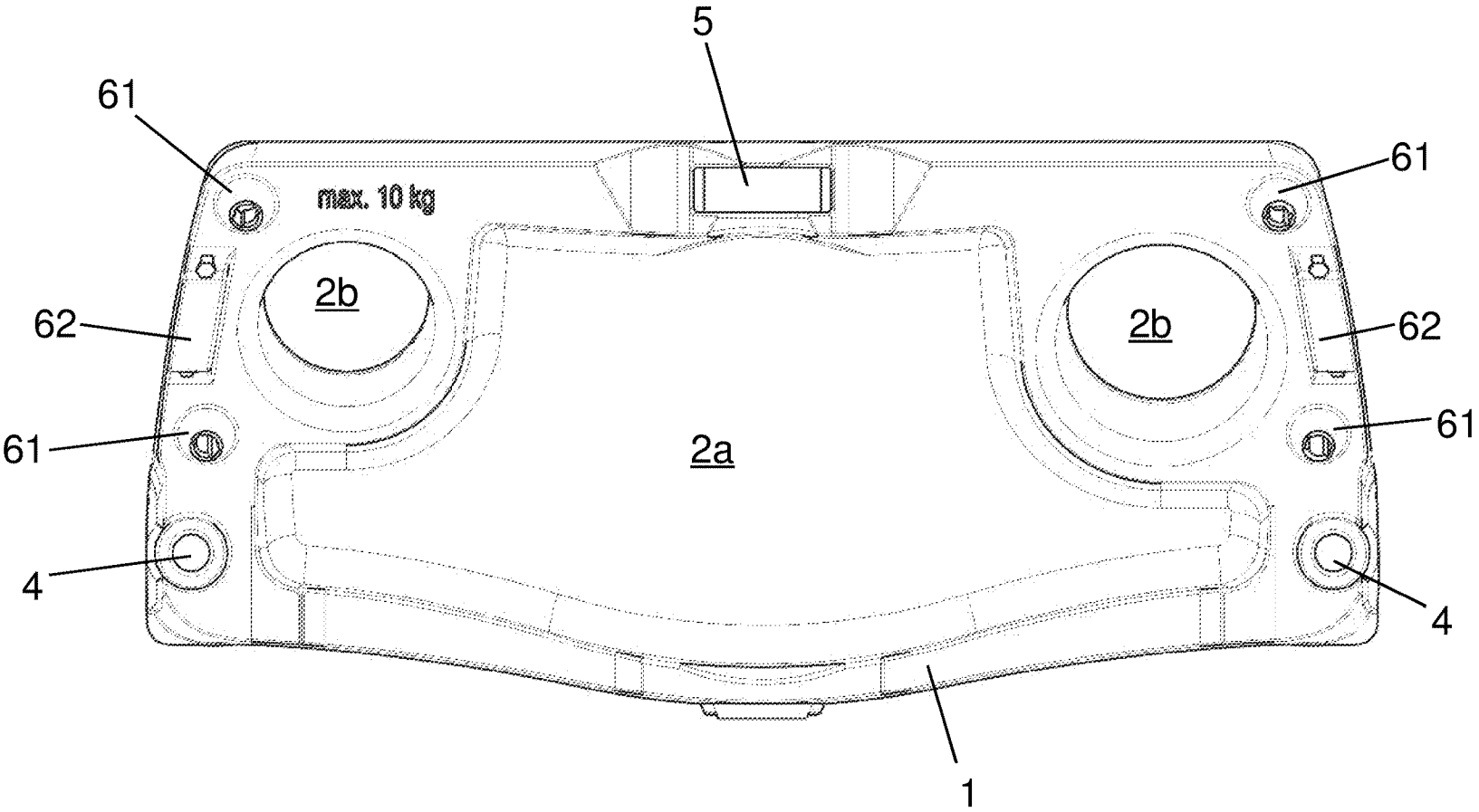
FIG. 2 is a top view onto the storage tray.
Figure 2A:
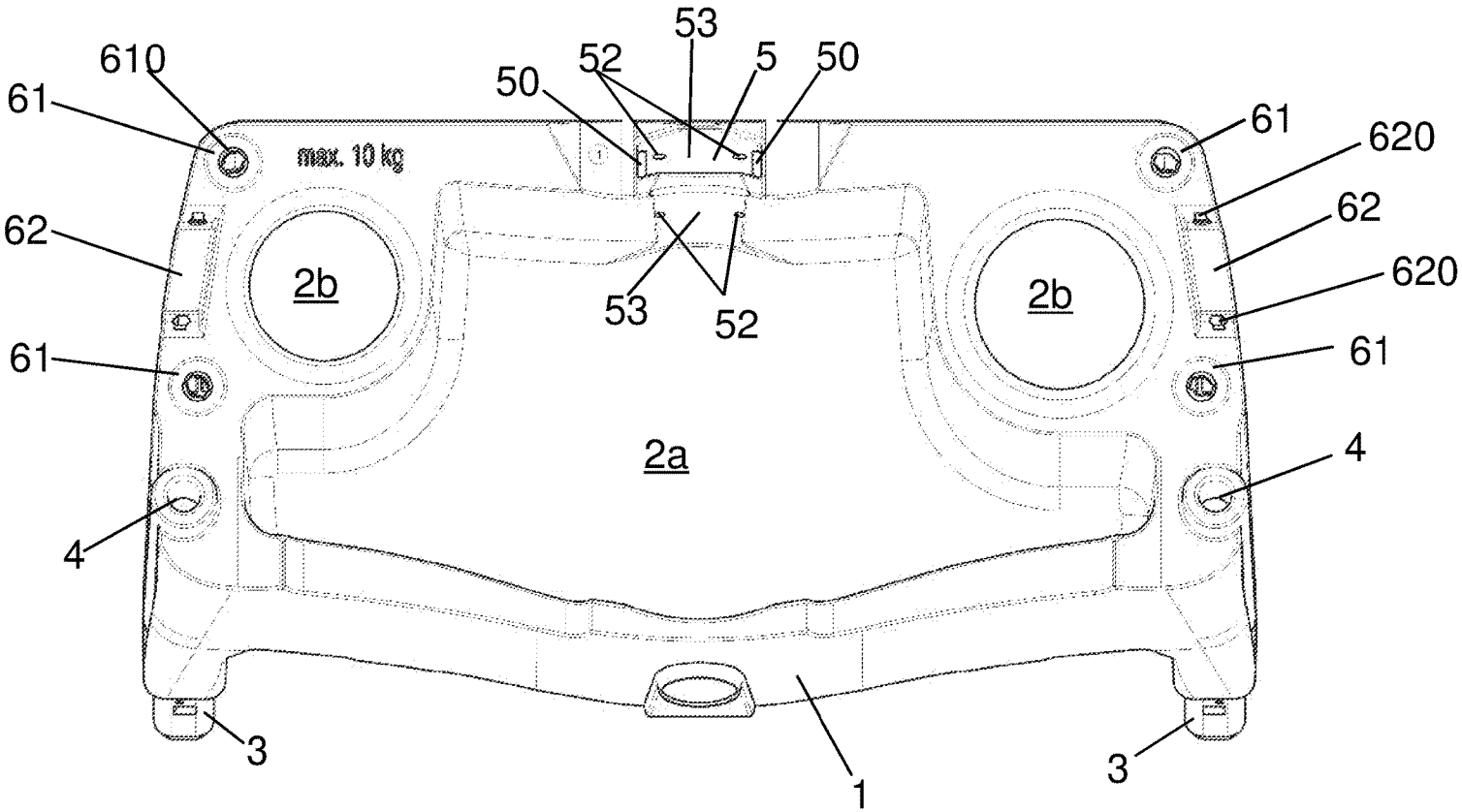
FIG. 2*a* is a view of the storage tray from top, rotated slightly relative to the top view in FIG. 2.
Figure 3:
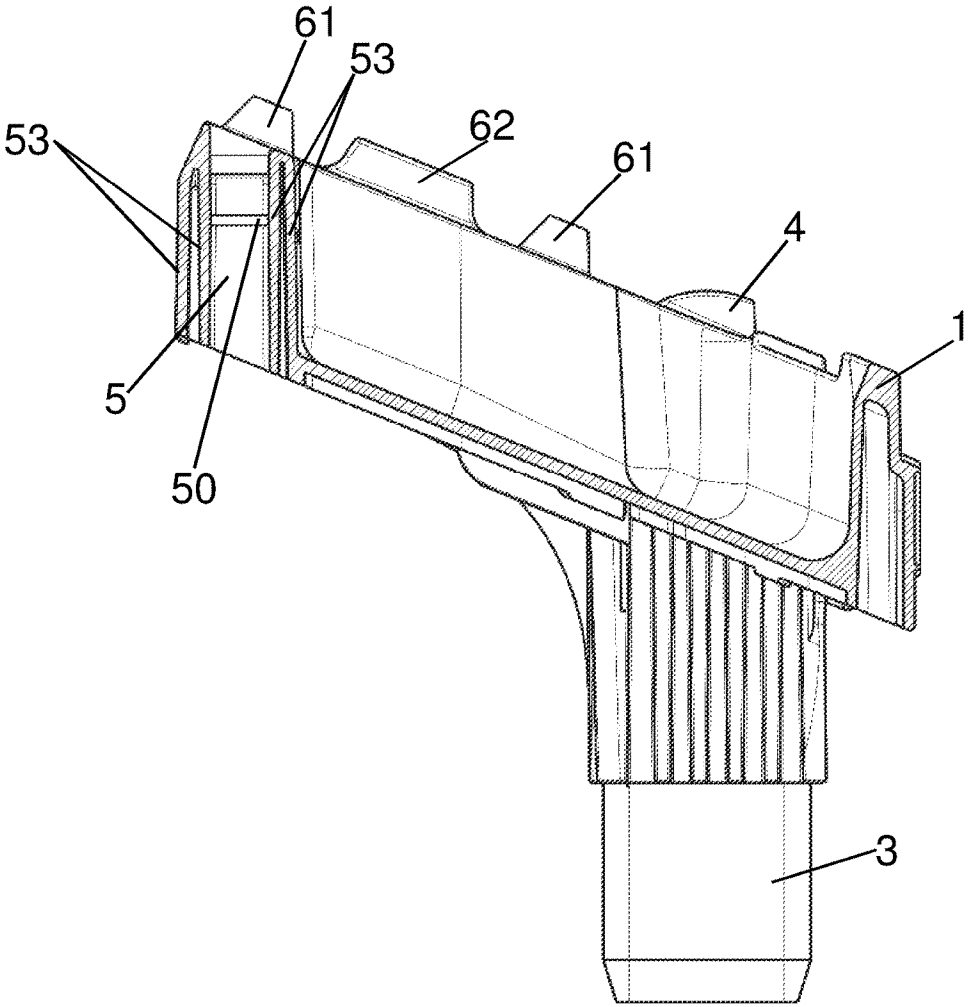
FIG. 3 is a view of the storage tray onto a cross-sectional surface in FIG. 2.
Figure 4:
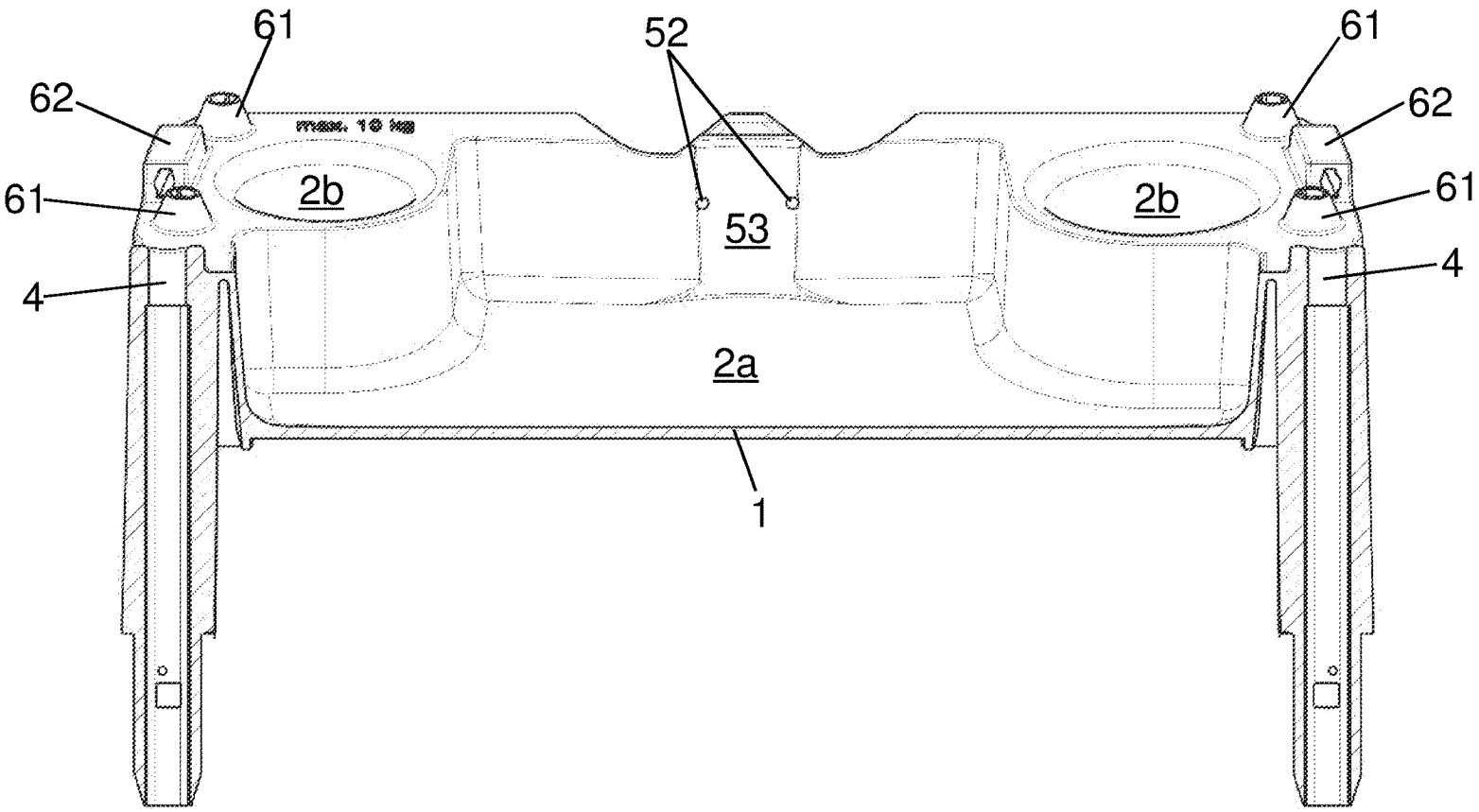
FIG. 4 is a view of the storage tray onto a cross-sectional surface IV-IV in FIG. 2.
Figure 5:
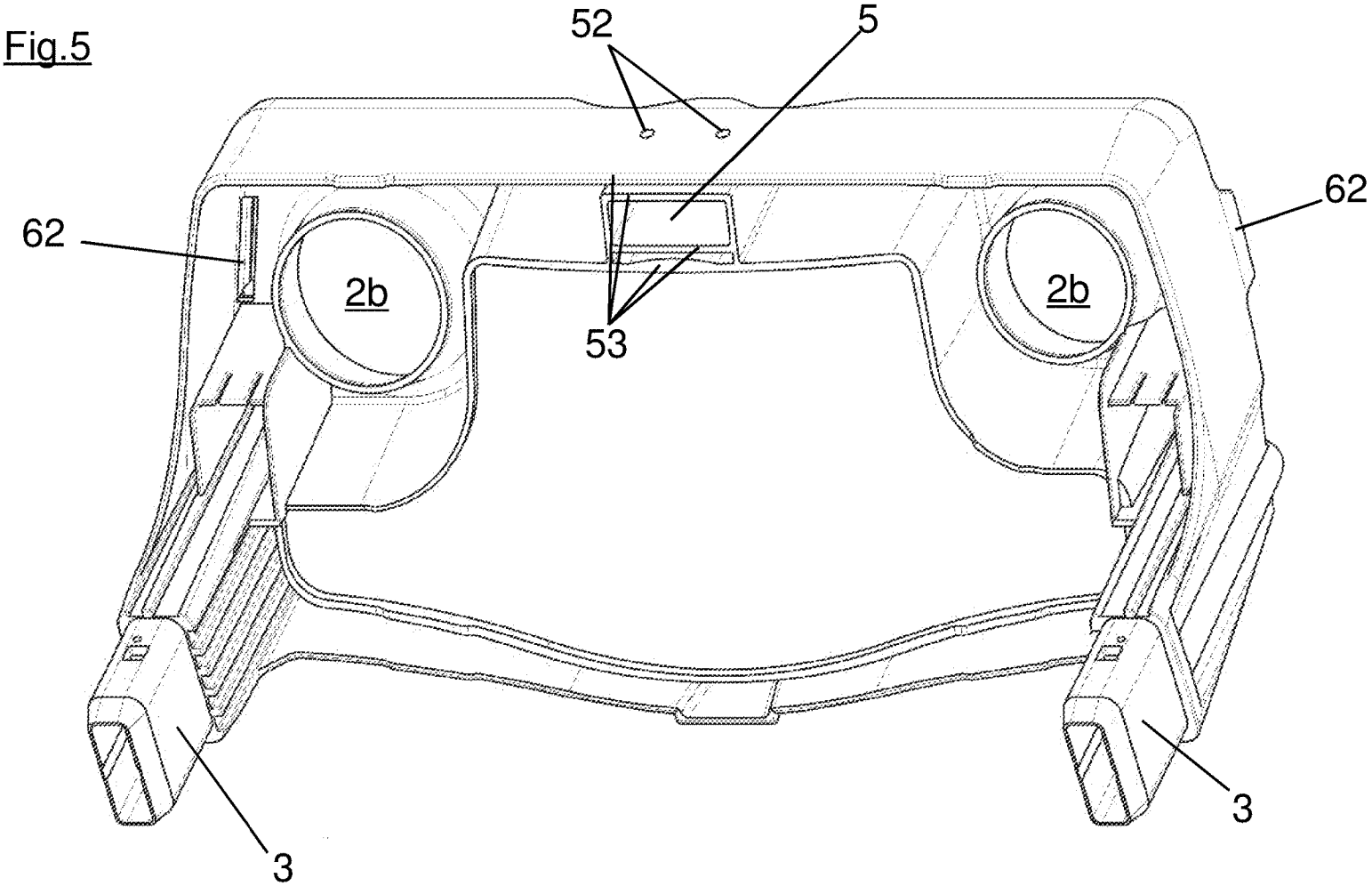
FIG. 5 is a view of the storage tray from the frog perspective.
Figure 6:
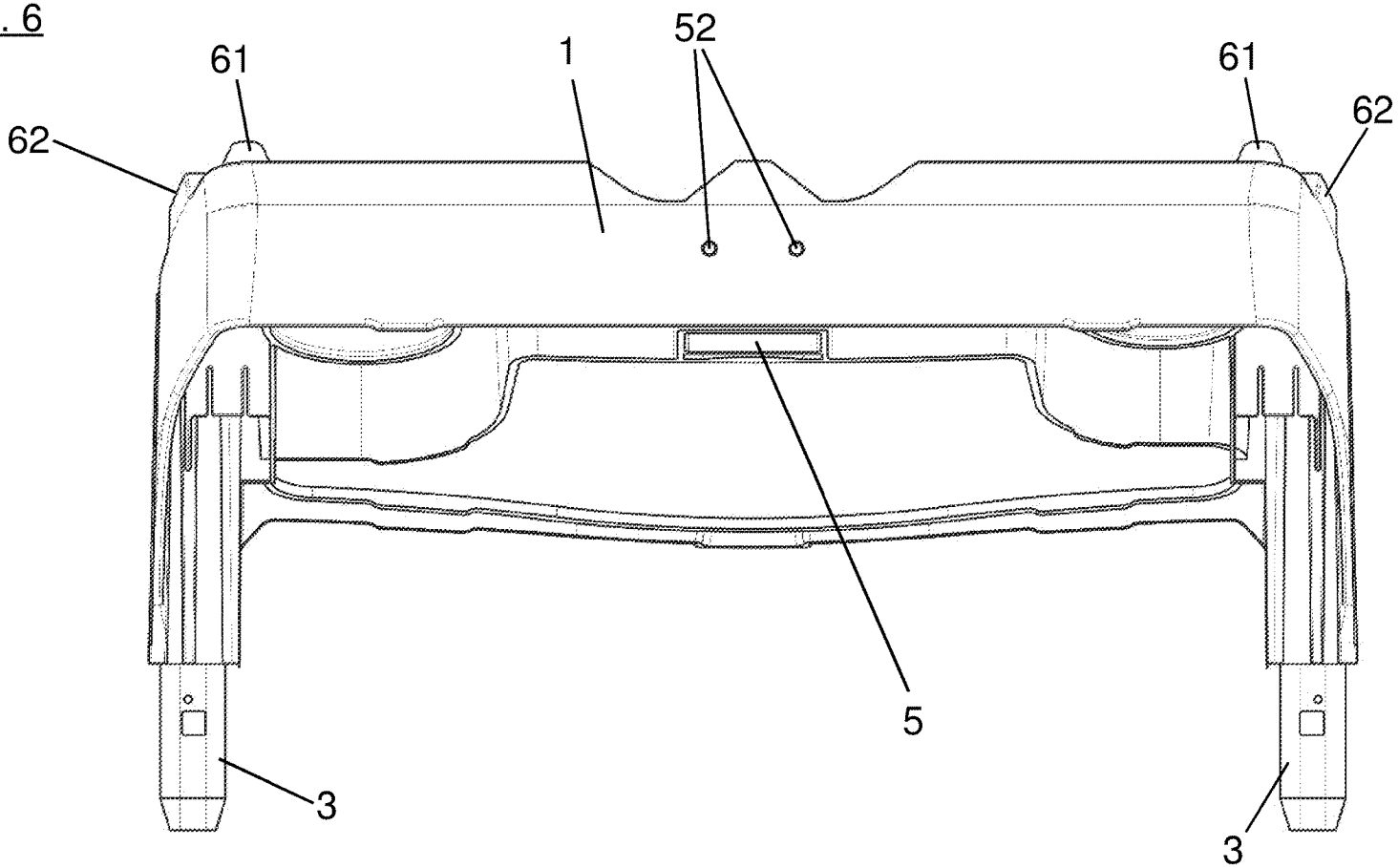
FIG. 6 is a view of the storage tray from the rear (see arrow VI in FIG. 4).
Figure 7:
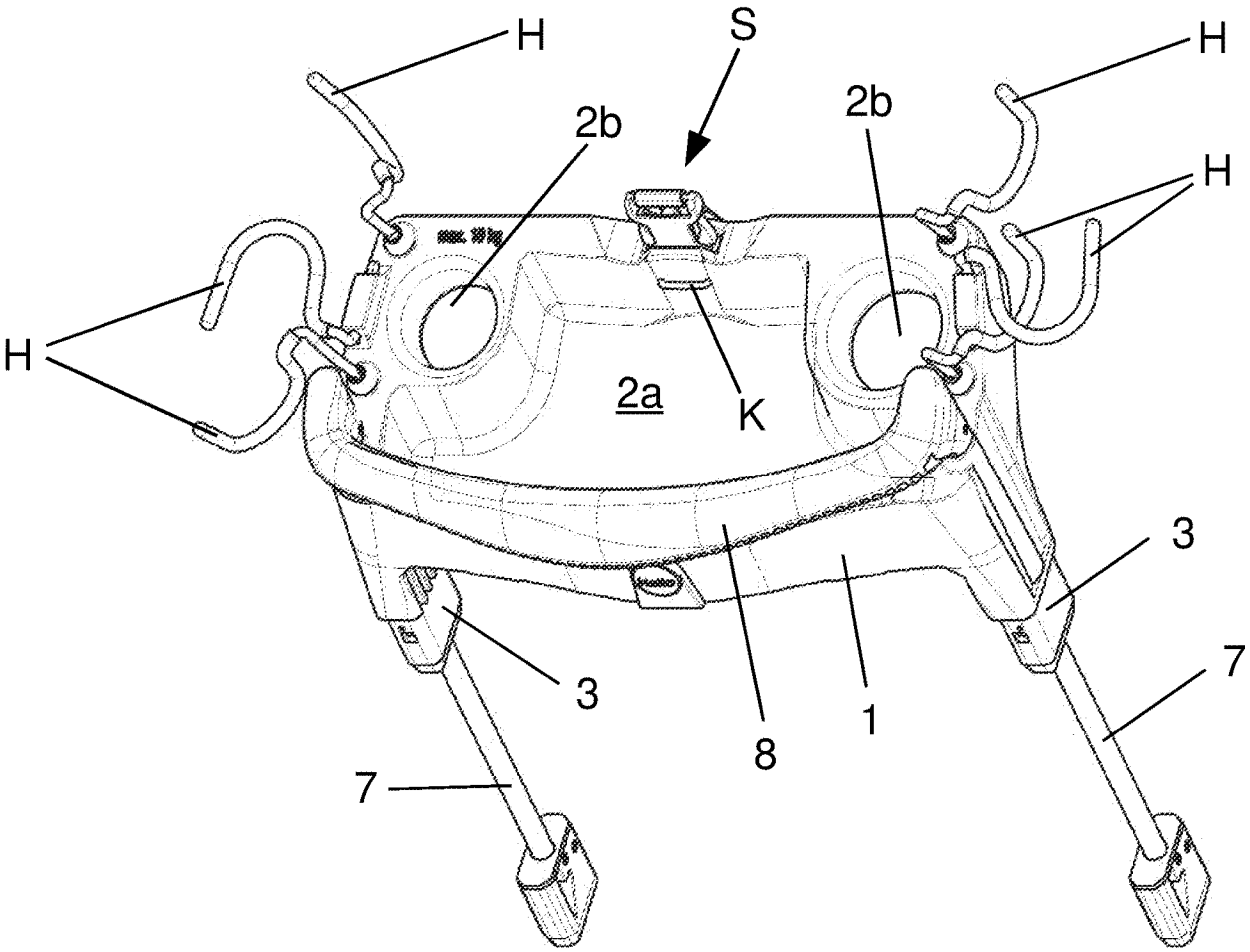
FIG. 7 is a view of an arrangement of the storage tray according to the described apparatus pursuant to FIGS. 1 to 6, a bar, a belt, a buckle closure and hook.
Figure 8:
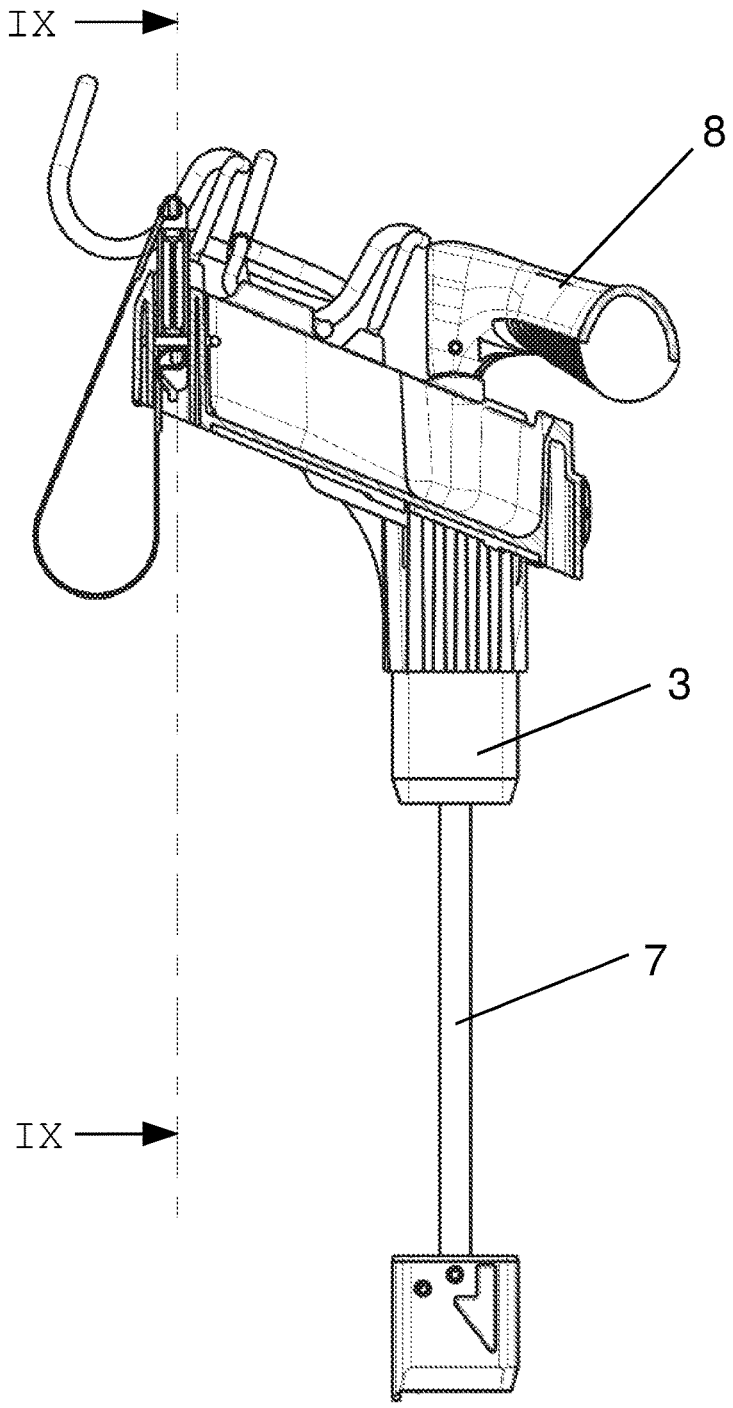
FIG. 8 is a cross-sectional view of the arrangement.
Figure 8A:
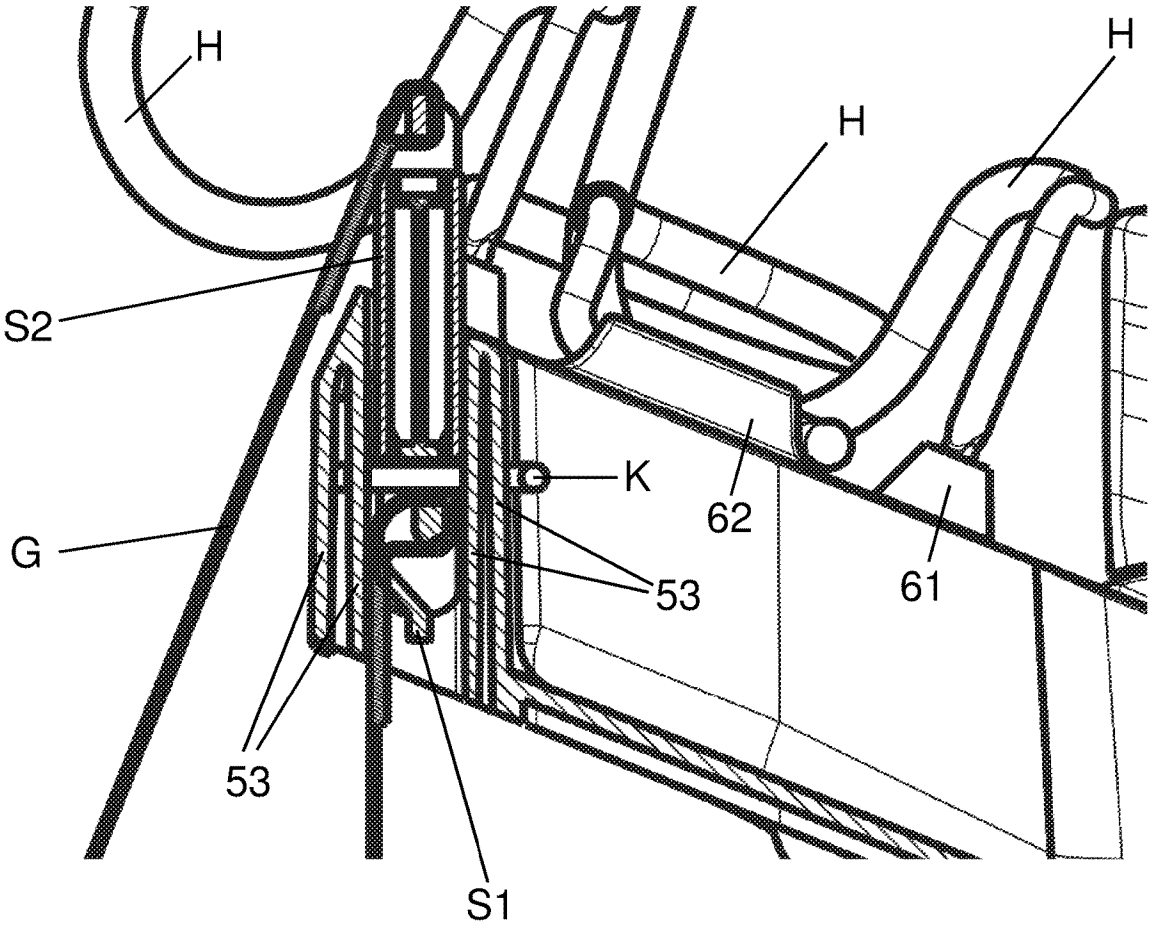
FIG. 8*a* is a detail from the cross-sectional view of FIG. 8.
Figure 9:
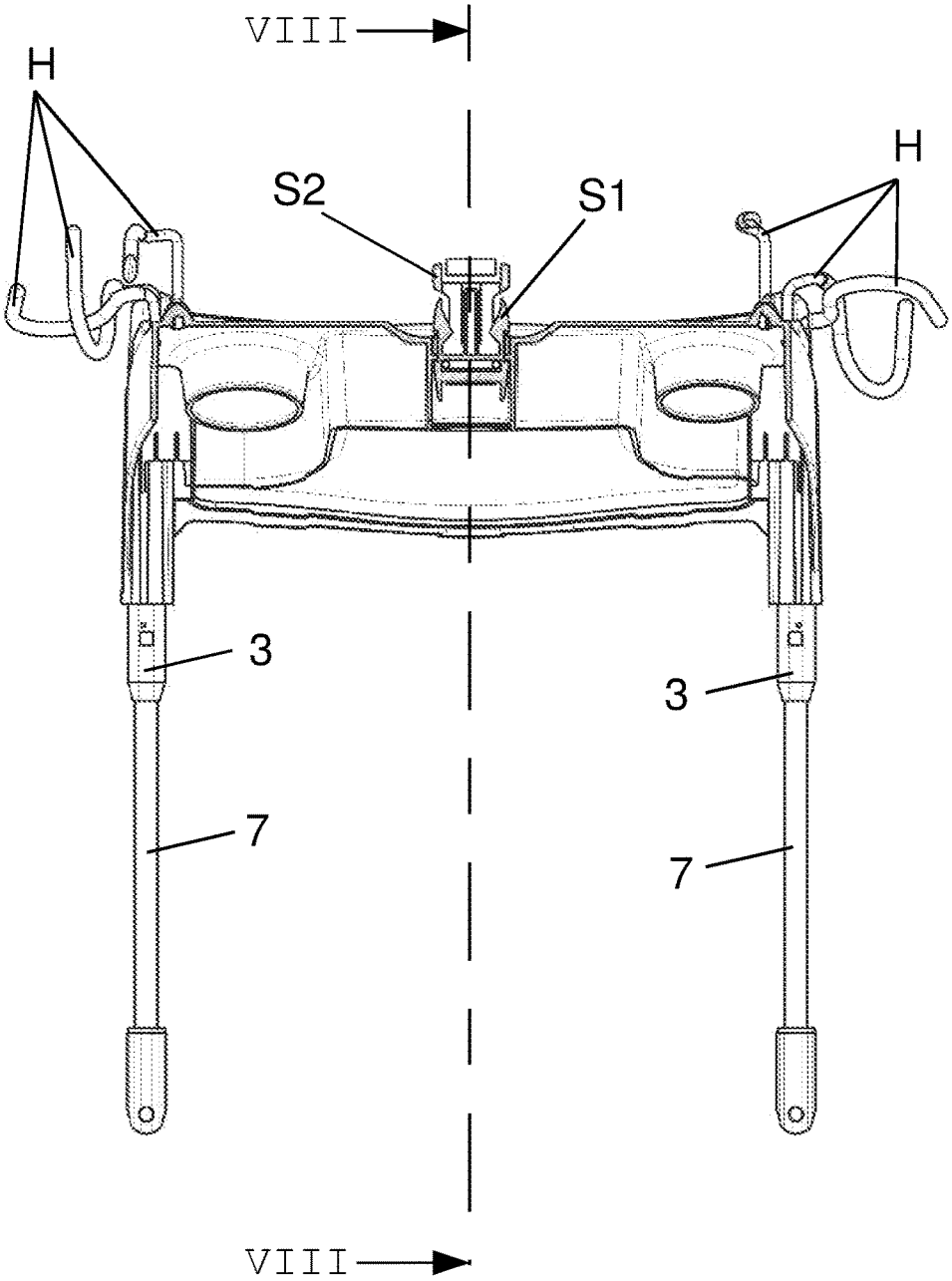
FIG. 9 is a view of the arrangement onto a cross-sectional surface IX-IX in FIG. 8.
Figure 9A:
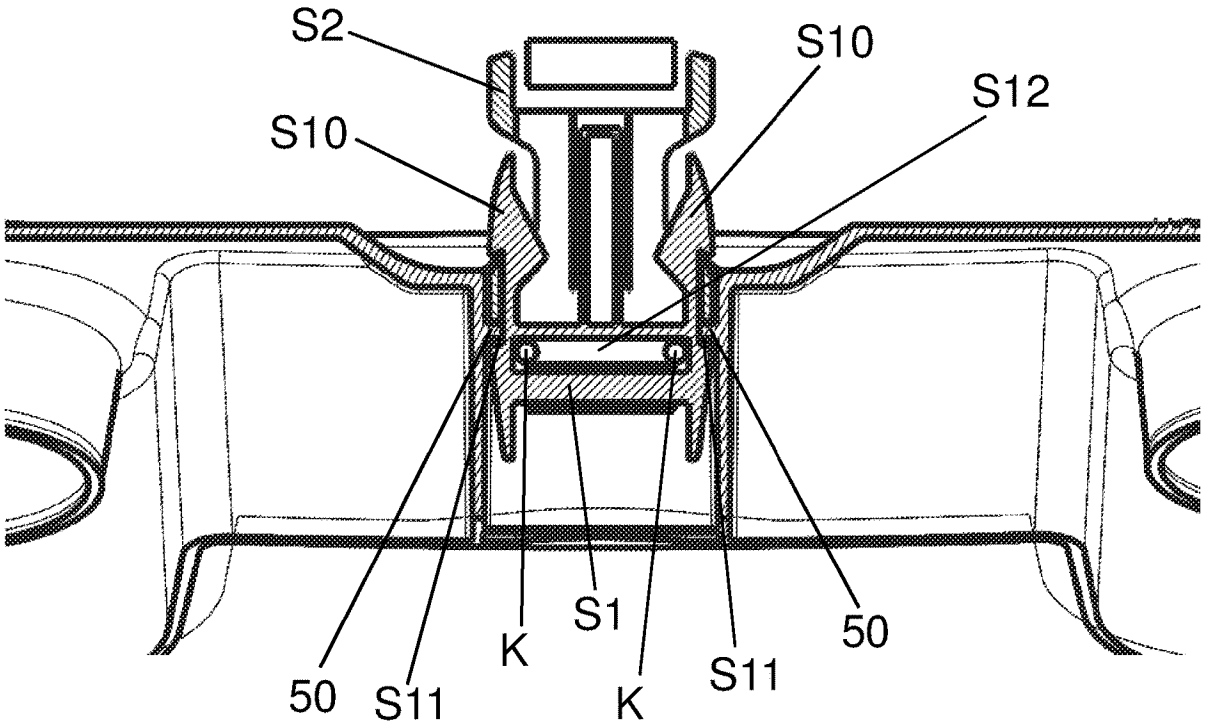
FIG. 9*a* is a detail from the cross-sectional view in FIG. 9.
Figure 10:
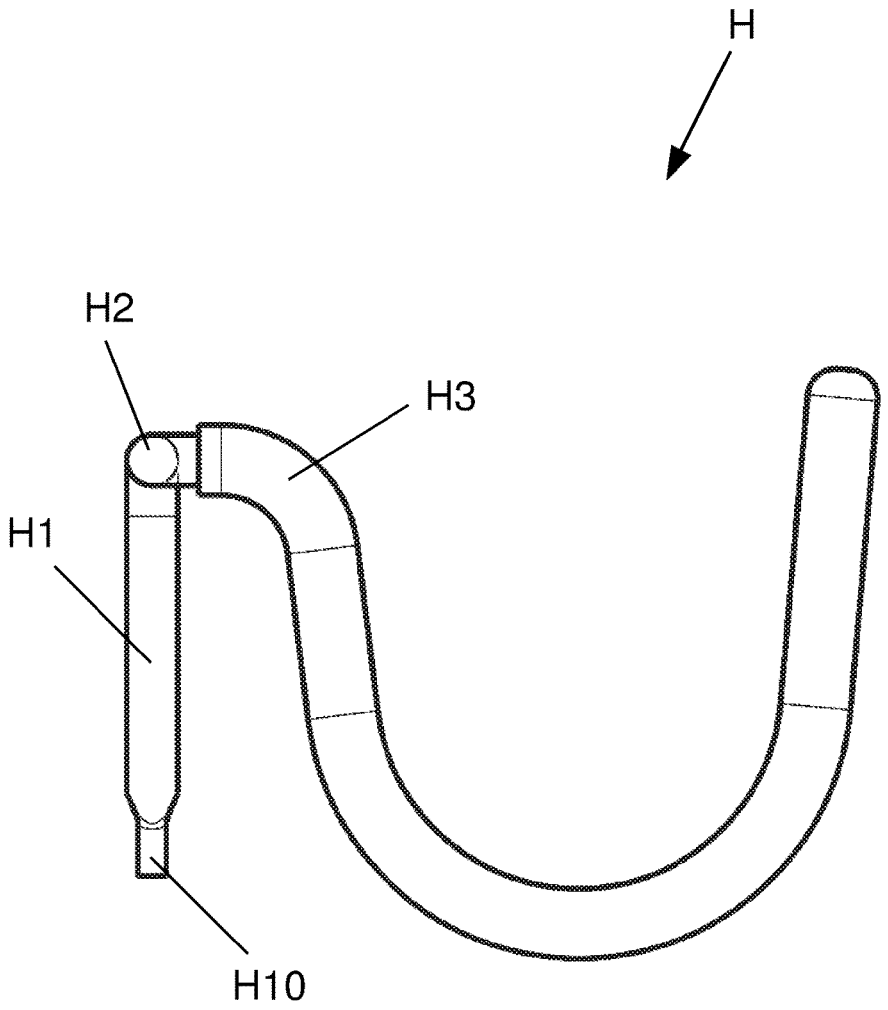
FIG. 10 is a first view of a hook.
Figure 11:
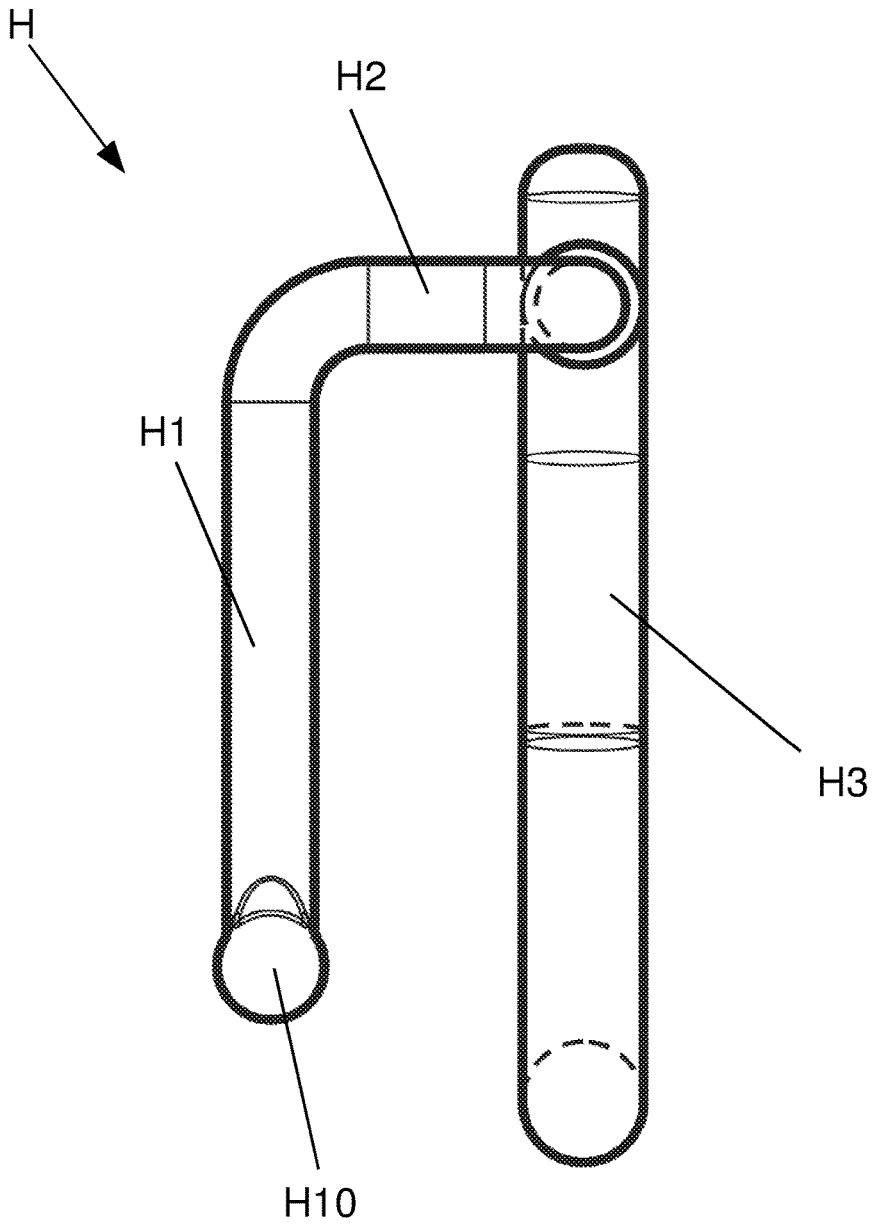
FIG. 11 is a second view of a hook.
Figure 12:
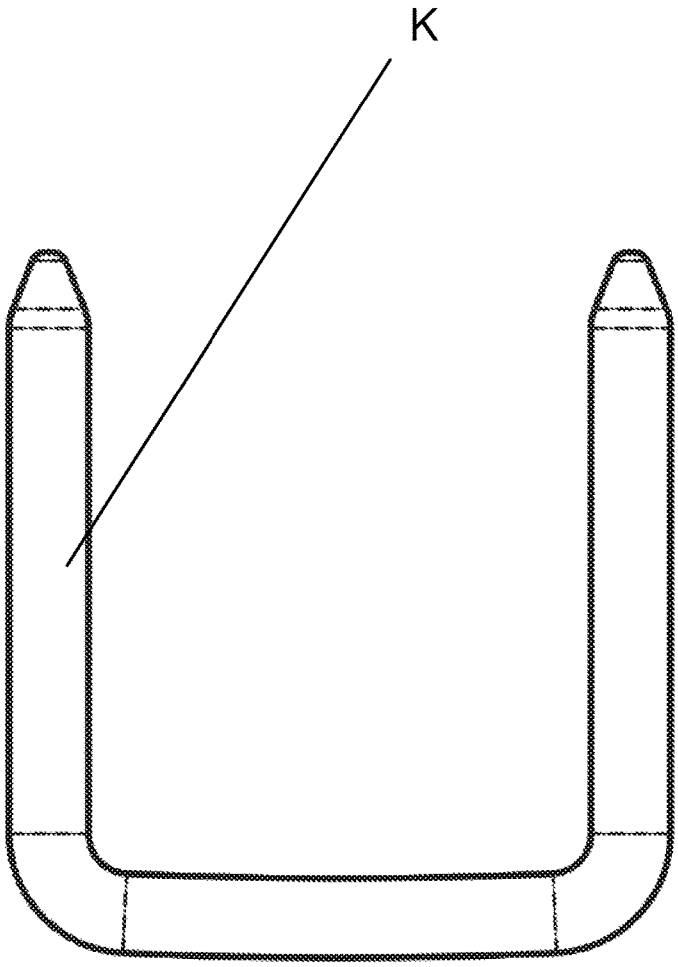
FIG. 12 is a view of a clamp.

In at least a region 610, 620, the second receivers 61, 62 feature a first non-circular cross-sectional area (see in particular FIG. 2*a*, second receivers 61, 62). This first cross-sectional area is selected such that it is adapted to a section H10 with a first cross-sectional area of an insert section H1 of hooks H. The insert section H1 has this first cross-sectional area in section H10, which is inserted first into the second receivers 61, 62 when the user attaches a hook H in the second receiver 61, 62. This end section H1 with the first cross-section area interacts similarly to a key and a keyhole with the region 610, 620 of the second receivers 61, 62 with the first cross-section area. An insertion is possible only in certain orientations. In the same manner, a hook can only be disengaged, that is to say the insert section of the hook can only be pulled out in certain orientations. While this does not completely prevent an accidental falling out, this is at least drastically restricted.

Preferably, it is possible that the first cross-sectional area in end section H10 of the insert section H1 is additionally slightly oversized, thus only permitting the insert section H1 to be inserted into the second receivers 61, 62 based on a slightly elastic deformation. This also secures the hook H against accidentally falling out.

The two second receivers 62 can feature a region 620 with a first cross-sectional area both in a beginning region as well as in an ending region (when viewed in insert direction of the insert sections of hook H).

In addition to the insert section H1, the hooks H have an interim section H2 angled at approximately 90° to insert section H1. Hook section H3 in turn extends at a 90° angle from the interim section H2. Hook section H3 is used to hang into or onto objects to be attached on storage tray A. This hook section H3 essentially features a U-shaped bend and is equipped with a slip-reducing plastic coating.

What is claimed is:

1. An arrangement comprising:

a storage tray for a runged stepladder, the storage tray comprising:

at least one compartment into which objects can be placed; and a plurality of receivers for hooks that are attachable to the storage tray; and a hook having an insert section insertable into one of the receivers, wherein at least a section of each of the receivers has a non-circular first cross-sectional area, and wherein the insert section of the hook in at least one location or in a section has a non-circular cross-sectional area that corresponds to the non-circular first cross-sectional area of the receivers.

2. The arrangement of claim 1, wherein at least one of the receivers has a receiving direction oriented in parallel with an upper side of the storage tray.

3. The arrangement of claim 1, wherein at least one of the receivers has a receiving direction oriented vertically to an upper side of the storage tray.

4. The arrangement of claim 1, wherein the hook has an interim section angled at approximately 90° to the insert section, and has a hook section angled at approximately 90° to the interim section, wherein the interim section connects the insert section and the hook section to each other.

5. A storage tray for a runged stepladder, comprising:

at least one compartment into which objects can be placed; and a first receiver for a first element of a buckle closure that is attachable to the storage tray, wherein the first receiver is a through hole in which at least one catch is arranged for the first element of the buckle closure, wherein the first element of the buckle closure is guidable into the first receiver from a first side of the storage tray, and wherein a second element of the buckle closure is insertable into the first receiver from a second side of the storage tray.

6. A storage tray for a runged stepladder, comprising:

at least one compartment into which objects can be placed; and a first receiver for a first element of a buckle closure that is attachable to the storage tray, wherein the first receiver is a through hole in which at least one catch is arranged for the first element of the buckle closure, and wherein the storage tray has at least a first hole transverse to the first receiver, through which a locking device is guidable into the first receiver to secure the first element of the buckle closure.

7. An arrangement comprising:

a storage tray for a runged stepladder;

a belt; and a locking device;

wherein the storage tray comprises:

at least one compartment into which objects can be placed, a first receiver for a first element of a buckle closure that is attachable to the storage tray, wherein the first receiver is a through hole in which at least one catch is arranged for the first element of the buckle closure, and at least one first hole transverse to the first receiver, wherein the buckle closure includes the first element attached on a first end of the belt, the first element of the buckle closure being guidable into the first receiver of the storage tray from a first side of the storage tray and being attached in the first receiver with the catch in contact with the first receiver, and wherein the locking device is guidable through the at least one first hole into the storage tray into a pocket in the first element of the buckle closure in order to secure the first element of the buckle closure against being pulled out from the first receiver.

8. An arrangement comprising:

a storage tray for a runged stepladder; and a belt, wherein the storage tray comprises:

at least one compartment into which objects can be placed, and a first receiver for a first element of a buckle closure that is attachable to the storage tray, wherein the first receiver is a through hole in which at least one catch is arranged for the first element of the buckle closure, wherein the buckle closure includes:

the first element attached on a first end of the belt, the first element of the buckle closure being guidable into the first receiver of the storage tray from a first side of the storage tray and being attached in the first receiver with the catch in contact with the first receiver, and a second element attached on a second end of the belt.

* * * * *